US009044942B2

(12) United States Patent
Browning et al.

(10) Patent No.: US 9,044,942 B2
(45) Date of Patent: Jun. 2, 2015

(54) THERMAL SENSING FLUID EJECTION ASSEMBLY AND METHOD

(75) Inventors: Robert N. K. Browning, Corvallis, OR (US); James Gardner, Corvallis, OR (US); Eric Martin, Corvallis, OR (US); Andrew L. Van Brocklin, Corvallis, OR (US); Mark Hunter, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/818,421

(22) PCT Filed: Sep. 30, 2010

(86) PCT No.: PCT/US2010/050853

§ 371 (c)(1),
(2), (4) Date: Feb. 22, 2013

(87) PCT Pub. No.: WO2012/044299

PCT Pub. Date: Apr. 5, 2012

(65) Prior Publication Data

US 2013/0155142 A1 Jun. 20, 2013

(51) Int. Cl.

| | |
|---|---|
| ***B41J 29/393*** | (2006.01) |
| ***B41J 2/135*** | (2006.01) |
| ***B41J 2/14*** | (2006.01) |

(52) U.S. Cl.

CPC ..... *B41J 2/135* (2013.01); *B41J 2/1408* (2013.01); *B41J 2/14145* (2013.01)

(58) Field of Classification Search

CPC ..... B41J 2/0454; B41J 2/04563; B41J 2/38
See application file for complete search history.

(56) References Cited

U.S. PATENT DOCUMENTS

| | | | | |
|---|---|---|---|---|
| 5,424,767 | A | 6/1995 | Alavizadeh et al. | |
| 5,635,964 | A | 6/1997 | Burr et al. | |
| 6,422,677 | B1 | 7/2002 | Deshpande et al. | |
| 6,641,243 | B2 | 11/2003 | Anderson et al. | |
| 6,802,585 | B1 | 10/2004 | Wratchford | |
| 6,808,243 | B1 | 10/2004 | Markham et al. | |
| 8,070,263 | B2 * | 12/2011 | Oohashi et al. | 347/58 |
| 2006/0292511 | A1 * | 12/2006 | Habuka | 432/18 |
| 2008/0084441 | A1 | 4/2008 | Sheahan et al. | |

FOREIGN PATENT DOCUMENTS

| | | |
|---|---|---|
| KR | 100492115 | 6/2005 |
| KR | 20090001219 | 6/2005 |
| KR | 20060135453 | 12/2006 |

* cited by examiner

*Primary Examiner* — Julian Huffman
(74) *Attorney, Agent, or Firm* — Hewlett-Packard Patent Department

(57) ABSTRACT

A fluid ejection assembly includes a fluid slot formed in a die. The assembly also includes a nozzle column is formed along a side of the fluid slot. The assembly also includes a pair of thermal sensors to measure die temperature at the middle of the nozzle column and at a first end of the nozzle column.

19 Claims, 7 Drawing Sheets

THERMAL SENSING FLUID EJECTION ASSEMBLY AND METHOD

BACKGROUND

In a thermal bubble inkjet printing system, an inkjet printhead prints an image by ejecting ink drops through a plurality of nozzles onto a print medium, such as a sheet of paper. The nozzles are typically arranged in one or more arrays or columns such that properly sequenced ejection of ink from the nozzles causes characters and/or images to be printed on the print medium as the printhead and print medium move relative to each other. Thermal inkjet (TIJ) printheads eject fluid drops from a nozzle by passing electrical current through a heating element to generate heat and vaporize a small portion of the fluid within a firing chamber. The rapidly expanding vapor bubble forces a small fluid drop out of the firing chamber nozzle. When the heating element cools, the vapor bubble quickly collapses, drawing more fluid from a reservoir into the firing chamber in preparation for ejecting another drop from the nozzle.

During printing, heat from the heating elements affects the temperature of the thermal inkjet (TIJ) die. Thermal differences over the nozzle column area of the TIJ die have a significant influence on characteristics of the ink drops being fired from the nozzles, and can therefore have an adverse impact on the overall print quality of the printing system. For example, a higher die temperature results in a higher drop weight and drop velocity, while a lower die temperature results in a lower drop weight and velocity. Thus, variations in temperature across the die can result in variations in drop weight, velocity and shape. Differences in the drop weight, velocity and shape can have a considerable impact on the print quality. For example, drops with lower drop weight ejected from cooler areas of the die can result in printed areas on the print medium that have less ink than intended. The areas printed with less ink will appear to be lighter than other areas printed with drops of higher drop weight ejected from warmer areas of the die. Variations in drop characteristics can also adversely affect the color accuracy of the printing system. In general, print quality problems associated with inconsistent drop characteristics caused by variations in temperature across the TIJ die are referred to as light area banding (LAB), die boundary banding (DBB), and hue shift.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Overview of Problem and Solution

Figure 1:
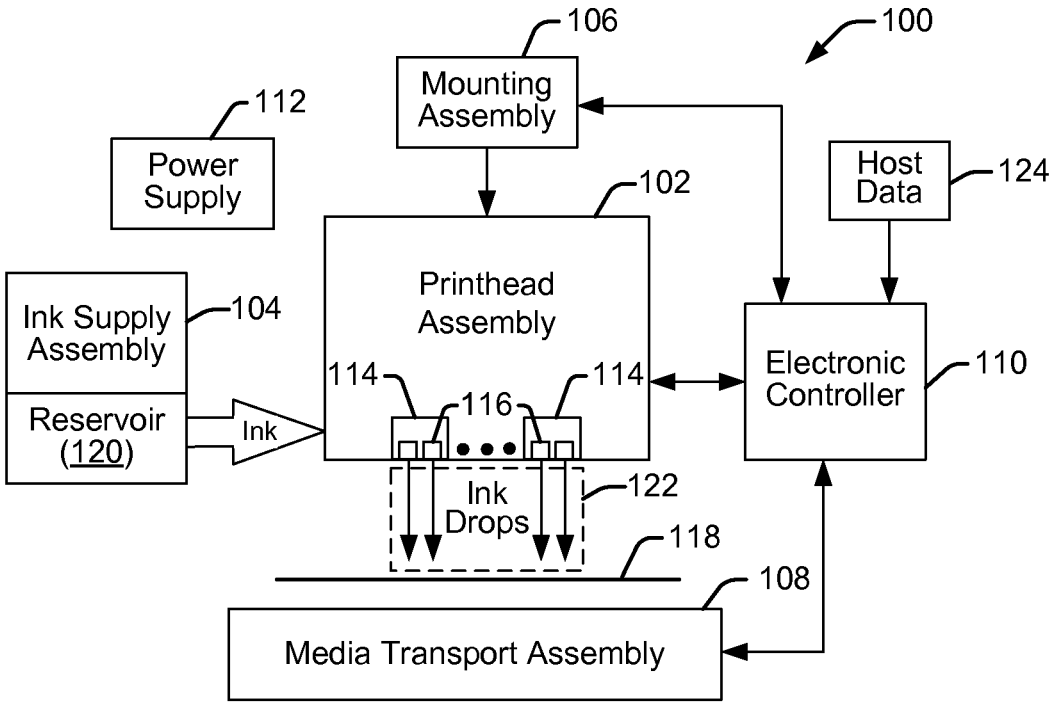
FIG. 1 shows an inkjet printing system suitable for incorporating a fluid ejection assembly, according to an embodiment.

As noted above, in thermal inkjet (TIJ) printing systems, variations in temperature across the TIJ die in the areas of the nozzle columns influence characteristics of the ink drops (e.g., drop weight, drop velocity or drop shape) being ejected from nozzles onto the print medium. This causes problems such as light area banding (LAB), die boundary banding (DBB), and hue shift, all of which reduce the overall print quality of the printing system.

A source of these problems is an imbalance between the heat being input and the heat being removed across different regions of the TIJ printhead die during operation. A conventional TIJ printhead includes a die carrier, a silicon die, and an adhesive layer that bonds the die to the die carrier. A chamber layer on top of the die includes fluid chambers, each having a firing resistor located on the die at the bottom of the chamber. The chamber layer is covered by a nozzle layer having nozzles (orifices) that correspond with each chamber. The nozzles form a print column, or nozzle column, on either side of an elongated fluid slot (e.g., an ink-feed slot) that is formed in the die and die carrier. The fluid slot and nozzle columns on either side of the slot extend between end regions of the die.

During operation, fluid supplied by the fluid slot is ejected through nozzles in the nozzle column as firing resistors in the chambers heat up and create expanding vapor bubbles that force fluid drops through the nozzles. Excess heat generated by the firing resistors heats the die mostly in the nozzle column areas along the edges of the fluid slot. However, heat is generated predominantly along the nozzle columns, and very little near the die ends, past the ends of the columns (in the end regions) where there are no nozzles. In addition, although heat is primarily removed from the die by fluid flowing through the fluid slot and out the nozzles, the end regions of the die provide relatively large areas for heat to transfer out of the die and into the thermally conductive die carrier to which the die is bonded. The end regions also constitute significant thermal mass which directly absorbs heat. By contrast, there is less contact area between the die and die carrier in the middle of the die (i.e., the middle of the nozzle columns), resulting in less heat transfer out of the die at its center. Accordingly, these differences between heat input and heat removal across the surface of the die cause the end regions of the die to be typically cooler than the central regions of the die. Correspondingly, the ends of the nozzle columns are typically cooler than the middles of the nozzle columns.

Light area banding (LAB) and hue shift problems related to such temperature variation across the TIJ die affect both "scanning-carriage" (i.e., multi-pass) and "page-wide array" (i.e., single-pass) TIJ printing systems. Scanning-carriage TIJ printing systems have an inkjet printhead mounted on a carriage that moves back and forth across the print media. Prior methods of addressing such print defects in scanning-carriage TIJ systems typically involve algorithmic solutions that perform additional overlapping passes across the print media. Although the additional passes are effective in covering such print defects, they have the disadvantage of requiring significant additional print time. Page-wide array TIJ printing systems have multiple printhead die in a printhead module that can print wide swaths spanning much or all of an entire page width. Prior methods of addressing LAB and hue shift print defects in page-wide array TIJ systems generally involve using extra print bars that employ additional printhead die. Although the additional printhead die provide extra print coverage to effectively avoid these print defects, this method of solving the problem has the disadvantage of adding significant cost to the printing system.

Embodiments of the present disclosure overcome disadvantages such as those mentioned above, generally by sensing the die temperature at different locations across the die and heating the die in a spatially differential manner in response to the sensed die temperatures. A control system includes sensors that measure die temperatures at the middle and ends of the die's nozzle columns. The system produces error signals proportional to temperature differences between the middle and ends of the columns or die. The error signals drive heaters that heat areas of the die, such as the end areas of the die, at power levels proportional to the error signals. Thus, a closed-loop heating system provides temperature control across the surface of a TIJ die that enables particular temperature profiles to be maintained between different areas of the die, such as between the middle and end of the die. Such temperature profiles can include, for example, a uniform temperature profile that maintains a uniform temperature (to within a target delta) between the middle and end of the die, a graduated temperature profile that increases the temperature of the die between the middle and end of the die, and so on.

In one embodiment, for example, a fluid ejection assembly includes a fluid slot formed in a die with a nozzle column along a side of the fluid slot. A pair of thermal sensors measures the temperature of the die at the middle of the nozzle column and at a first end of the nozzle column. A heater is located at one end of the die to heat the end of the die in response to die temperatures measured by the pair of thermal sensors. In another embodiment, a method includes sensing a first temperature at the center of a nozzle column formed in a fluid ejection die, sensing a second temperature at an end of the nozzle column, and generating an error signal proportional to a temperature difference between the first and second temperatures. In response to the error signal, then, the method includes heating the die near the end of the nozzle column. In still another embodiment, a thermal inkjet printing system includes a fluid ejection die having a fluid supply slot and a nozzle column to eject fluid droplets. A heating system is disposed on the die to maintain a temperature profile across the surface of the die through selective application of heat to different areas of the die in response to temperature data sensed at different areas of the die.

Illustrative Embodiments

FIG. 1 illustrates an inkjet printing system 100 suitable for incorporating a fluid ejection assembly as disclosed herein, according to an embodiment of the disclosure. In this embodiment, the fluid ejection assembly is disclosed as a fluid drop jetting printhead 114. Inkjet printing system 100 includes an inkjet printhead assembly 102, an ink supply assembly 104, a mounting assembly 106, a media transport assembly 108, an electronic controller 110, and at least one power supply 112 that provides power to the various electrical components of inkjet printing system 100. Inkjet printhead assembly 102 includes at least one fluid ejection assembly 114 (printhead 114) having a printhead die that ejects drops of ink through a plurality of orifices or nozzles 116 toward a print medium 118 so as to print onto print medium 118. Print medium 118 is any type of suitable sheet material, such as paper, card stock, transparencies, Mylar, and the like. Typically, nozzles 116 are arranged in one or more columns or arrays such that properly sequenced ejection of ink from nozzles 116 causes characters, symbols, and/or other graphics or images to be printed upon print medium 118 as inkjet printhead assembly 102 and print medium 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form a one-way ink delivery system or a recirculating ink delivery system. In a one-way ink delivery system, substantially all of the ink supplied to inkjet printhead assembly 102 is consumed during printing. In a recirculating ink delivery system, however, only a portion of the ink supplied to printhead assembly 102 is consumed during printing. Ink not consumed during printing is returned to ink supply assembly 104.

In one embodiment, inkjet printhead assembly 102 and ink supply assembly 104 are housed together in an inkjet cartridge or pen. In another embodiment, ink supply assembly 104 is separate from inkjet printhead assembly 102 and supplies ink to inkjet printhead assembly 102 through an interface connection, such as a supply tube. In either embodiment, reservoir 120 of ink supply assembly 104 may be removed, replaced, and/or refilled. In one embodiment, where inkjet printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions inkjet printhead assembly 102 relative to media transport assembly 108, and media transport assembly 108 positions print medium 118 relative to inkjet printhead assembly 102. Thus, a print zone 122 is defined adjacent to nozzles 116 in an area between inkjet printhead assembly 102 and print medium 118. In one embodiment, inkjet printhead assembly 102 is a scanning type printhead assembly. In a scanning type printhead assembly, mounting assembly 106 includes a carriage for moving inkjet printhead assembly 102 relative to media transport assembly 108 to scan print medium 118. In another embodiment, inkjet printhead assembly 102 is a non-scanning type printhead assembly. In a non-scanning printhead assembly, mounting assembly 106 fixes inkjet printhead assembly 102 at a prescribed position relative to media transport assembly 108. Thus, media transport assembly 108 positions print medium 118 relative to inkjet printhead assembly 102.

Electronic controller or printer controller 110 typically includes a processor, firmware, and other printer electronics for communicating with and controlling inkjet printhead assembly 102, mounting assembly 106, and media transport assembly 108. Electronic controller 110 receives host data 124 from a host system, such as a computer, and includes memory for temporarily storing data 124. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters. Using data 124, electronic controller 110 controls inkjet printhead assembly 102 to eject ink drops from nozzles 116. Thus, electronic controller 110 defines a pattern of ejected ink drops which form characters, symbols, and/or other graphics or images on print medium 118. The pattern of ejected ink drops is determined by the print job commands and/or command parameters from data 124.

In one embodiment, inkjet printhead assembly 102 includes one fluid ejection assembly 114 (printhead 114). In another embodiment, inkjet printhead assembly 102 is a wide-array or multi-head printhead assembly having multiple fluid ejection assemblies 114. In one wide-array embodiment, inkjet printhead assembly 102 includes a carrier that carries fluid ejection assemblies 114, provides electrical communication between fluid ejection assemblies 114 and electronic controller 110, and provides fluidic communication between fluid ejection assemblies 114 and ink supply assembly 104. In one embodiment, inkjet printing system 100 is a drop-on-demand thermal inkjet (TIJ) printing system wherein fluid ejection assembly 114 is a TIJ printhead 114, such as shown in FIGS. 2 and 3.

Figure 2:
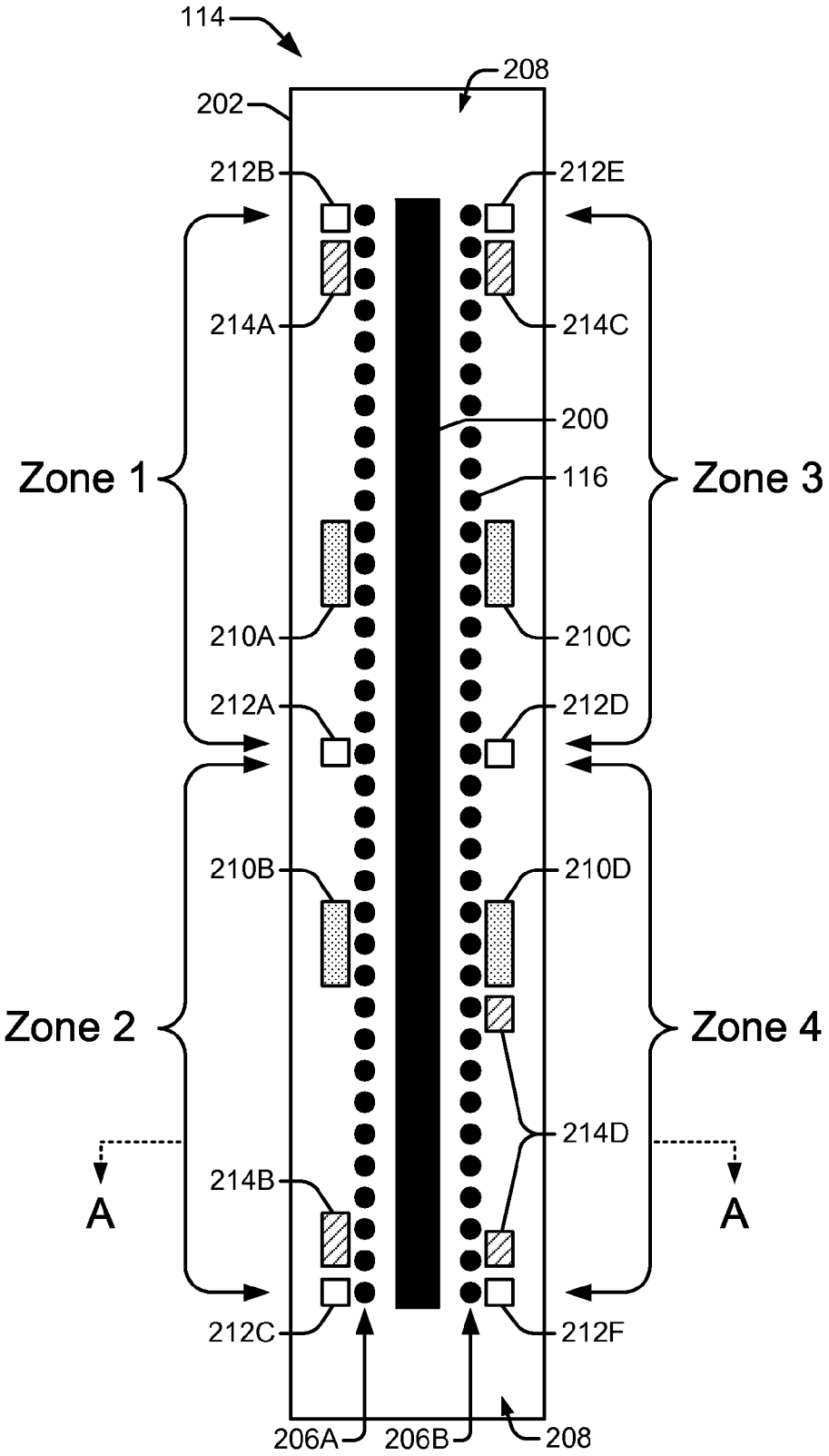
FIG. 2 shows a bottom view of a TIJ printhead as a fluid ejection assembly having a single fluid slot formed in a silicon die substrate, according to an embodiment.

FIG. 2 shows a bottom view of a TIJ printhead as fluid ejection assembly 114 having a single fluid slot 200 formed in a silicon die substrate 202, according to an embodiment of the disclosure. The die substrate 202 underlies a chamber layer having fluid chambers and a nozzle layer having nozzles 116 formed therein, as discussed below with respect to FIG. 3. However, for the purpose of illustration, the chamber layer and nozzle layer in FIG. 2 are assumed to be transparent in order to show the underlying die substrate 202.

Figure 3:
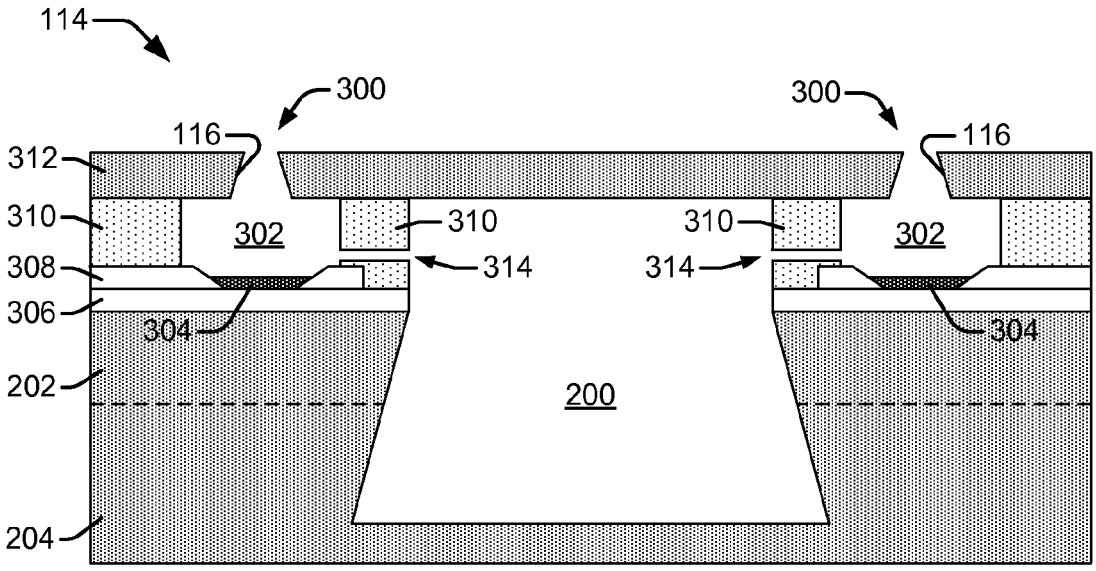
FIG. 3 shows a cross-sectional view of the fluid ejection assembly of FIG. 2, according to an embodiment.

FIG. 3 shows a cross-sectional view of the fluid ejection assembly 114 (TIJ printhead 114) taken along line A-A of FIG. 2, according to an embodiment of the disclosure. Fluid ejection assembly 114 includes a die carrier 204 and silicon die substrate 202 adhered to one another. The fluid slot 200 is an elongated slot formed in the die 202 and die carrier 204 that extends into the plane of FIG. 3. Fluid slot 200 is in fluid communication with a fluid supply (not shown), such as a fluid reservoir, and drop generators 300 are arranged along the sides of the fluid slot 200. Each drop generator 300 includes a nozzle 116, a firing chamber 302, and a firing element 304 disposed in the firing chamber 302. Nozzles 116 are generally arranged to form print or nozzle columns 206 (FIG. 2) along the sides of fluid slot 200. Firing element 304 is a thermal resistor formed of an oxide layer 306 on a top surface of the substrate 202 and a thin film stack 308 applied on top of the oxide layer 306. The thin film stack 308 generally includes an oxide layer, a metal layer defining the firing element 304, conductive traces, and a passivation layer. A chamber layer 310 has walls and chambers 302 that separate the substrate 202 from a nozzle layer 312. Nozzles 116 are formed in nozzle layer 312.

During operation, a fluid drop is ejected from a chamber 302 through a corresponding nozzle 116 and the chamber 302 is then refilled with fluid circulating from fluid slot 200 through a chamber inlet 314. More specifically, an electric current is passed through a resistor firing element 304 resulting in rapid heating of the element. A thin layer of fluid adjacent to the element 304 is superheated and vaporizes, creating a vapor bubble in the corresponding firing chamber 302. The rapidly expanding bubble forces a fluid drop out of the corresponding nozzle 116. When the heating element cools, the vapor bubble quickly collapses, drawing more fluid into the firing chamber 302 in preparation for ejecting another drop from the nozzle 116.

Referring again to FIG. 2, the fluid slot 200 and the left and right nozzle columns (columns 206A and 206B, respectively) on either side of the slot 200 extend between the die end areas 208 on the die substrate 202. The die ends 208 (i.e., areas above Zones 1 and 3, and below Zones 2 and 4) are generally used to define fluidic channels in the die 202, accommodate peripheral circuitry to control firing of thermal resistor elements 304, and connect the die 202 with the printer system. As noted above, during printing, the die ends 208 are cooler than the middle area of the die because the die ends 208 have no nozzles to generate heat and the larger silicon surface areas at the die ends 208 absorb and dissipate more heat. Zones 1, 2, 3 and 4, are thermal control zones. Thermal control zones 1, 2, 3 and 4, are located on the silicon ribs (ribs are described as regions of the silicon die laterally adjacent to a slot, or between a pair of slots) of the die 202 at the sides of the slot 200 where the nozzle columns 206 are formed. Each thermal control zone is generally defined by a closed-loop thermal control feedback circuit 210 (see FIG. 4) configured to measure temperature differences between different areas of the die 202 (e.g., between the middle of the die's nozzle/print column 206 and end of the column 206 at the die end 208) and to control temperatures across the different zone areas of the die 202 by compensating for the temperature differences. Each fluid slot 200 includes four thermal control zones around the slot. However, in other embodiments, additional thermal control zones may be implemented.

In one embodiment shown in FIG. 2, thermal sensors 212 are part of a closed-loop thermal control feedback circuit 210A and are fabricated in different locations on the die 202 to sense the die temperature. For example, thermal sensor 212A is located at the center-left of the die 202 near the middle of the left nozzle column 206A, and sensor 212B is located at the top-left die end 208 near the end of the left nozzle column 206A. Thermal sensors 212A and 212B form a pair of sensors that measure die temperature at the middle and the top end of the left nozzle column 206A. Although one intent of sensors 212 is to measure the die temperature at the middle and top end of the die 202 (i.e., the middle and end of the left nozzle column 206A), the location of sensors 212A and 212B is somewhat flexible, and their location as shown in FIG. 2 is intended to illustrate their general location on the die 202 rather than to indicate any limitation as to their precise location. The temperature measurements from sensors 212 at the different die locations enable the generation of an error signal (i.e., via a closed-loop thermal control feedback circuit 210A) proportional to temperature differences between the middle and top end of the die 202 or nozzle column 206A. In one embodiment, such an error signal drives a heating circuit 214A located at the top of the left nozzle column 206A near die end 208. The heating circuit 214A heats the top end area 208 of the die 202 at a power level proportional to the error signal. As noted above regarding the location of thermal sensors 212A and 212B, the location of heating circuit 214A as shown in FIG. 2 is intended to illustrate a general location on the die 202 for such a circuit rather than to indicate a limitation as to its precise location.

Furthermore, in some embodiments, a heating circuit 214 can be implemented as a split heating circuit having two or more heating circuits of lesser power distributed along a nozzle column 206 between the middle and ends of the nozzle column. For example, heating circuit 214D shown in FIG. 2, is located in zone 4 and is associated with feedback circuit 210D. Heating circuit 214D illustrates one possible implementation of a split heating circuit, having two sections distributed between the middle and an end of nozzle column 206B. Such split heating circuit designs can help provide a more even heating of the die 202 to maintain desired thermal profiles within a thermal zone and across the die 202. In other embodiments, one or more thermal resistor firing elements 304 (discussed above with respect to FIG. 3) can be engaged to function as a heating circuit 214. In such embodiments, firing elements 304 are driven at a sub-turn-on-energy (sub-TOE) level such that they do not eject drops of ink, but still generate heat to warm the die 202.

Figure 4:
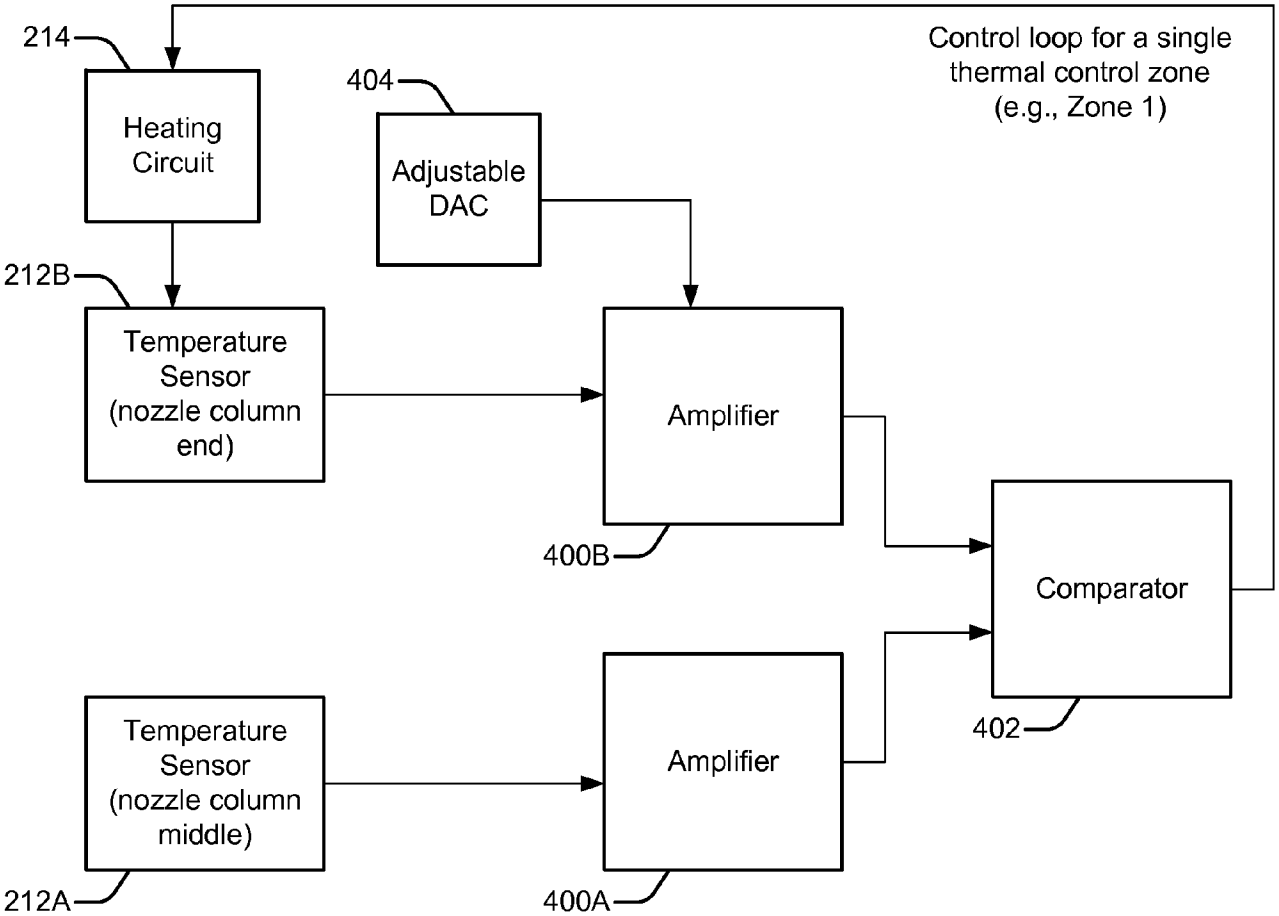
FIG. 4 shows a block diagram of a closed-loop thermal control feedback circuit, according to an embodiment.

FIG. 4 shows a block diagram of an example closed-loop thermal control feedback circuit 210, according to an embodiment of the disclosure. A closed-loop thermal control feedback circuit 210 is associated with each thermal control zone. For example, referring to FIG. 2, closed-loop thermal control feedback circuit 210A is associated with Zone 1, closed-loop thermal control feedback circuit 210B is associated with Zone 2, and so on. Each closed-loop thermal control feedback circuit 210 continuously senses and compares the temperature at the middle of a nozzle column 206 to the temperature at the end of the nozzle column 206. The result of this comparison causes a comparator to turn a heater circuit on and off as needed at the end of the nozzle column 206 when the ends of the die 202 are too cool. The heating circuit is turned on and off with a duty cycle that is proportional to the heating power needed to adjust the temperature at the end of the nozzle column 206 to within an acceptable delta from the temperature at the middle of the nozzle column 206. As heat from the heating circuit transfers through the die 202, a feedback loop is completed back to a thermal sensor. The temperature delta between the middle and end of the column 206 can be maintained such that various temperature profiles are possible across the thermal control zone.

Each closed-loop thermal control feedback circuit 210 includes a pair of thermal sensors 212, such as thermal sensors 212A and 212B located near the middle and top end of the left nozzle column 206A, respectively. Thermal sensors 212 are configured to output a temperature signal, represented as a certain change in voltage for a certain sensed temperature change in the areas of the die 202 where the sensors 212 are located. For example, as noted in FIG. 4, in one embodiment thermal sensors 212 are configured to output a 5.4 mV change for each 1 degree Celsius change in sensed temperature. In the illustrated embodiment, thermal sensors 212 are temperature sensing circuits that consist of stacked bipolar junction transistors (BJTs) biased with a stable current source. In this embodiment a 40 micro-ampere bias current with the transistor stack produces the voltage change of 5.4 mV per 1 degree Celsius change in temperature. Such thermal sensor circuit technology is generally well-known to those skilled in the art, however, and other thermal sensor implementations are therefore possible and are contemplated.

A closed-loop thermal control feedback circuit 210 also includes amplifiers 400 to amplify the temperature signals (i.e., voltages) output from each thermal sensor 212 (e.g., thermal sensors 212A and 212B). A comparator 402 is configured to output a duty cycle proportional error signal based on the amplified temperature signals from the thermal sensors 212. The error signal drives a heating circuit 214 located at the end of a nozzle column 206, such as heating circuit 214A at the end of the left nozzle column 206A. Heating circuits 214 can be configured, for example, with a resistor and a high-voltage MOSFET (metal-oxide semiconductor field-effect transistor) device. However, such circuits are generally well-known to those skilled in the art, and various configurations for heating circuits 214 are therefore possible and are contemplated. The error signal has a duty cycle proportional to the difference between the temperature signals from thermal sensors 212. In one embodiment, such as where a uniform temperature profile is desired between the middle and end of a nozzle column 206, the greater the difference between the temperature signals from a pair of thermal sensors 212 (e.g., sensors 212A and 212B), the longer the duty cycle is in the error signal being output from comparator 402. The error signal cycles the heating circuit 214 on and off according to the duty cycle such that greater differences between the temperature signals from thermal sensors 212 result in the heating circuit 214 being turned on a greater proportion of the time. Therefore, in such an embodiment as this where a uniform temperature profile is desired, the feedback circuit 210 controls the heating circuit 214 to increase the temperature at the end of the nozzle column 206 to reach and maintain a zero temperature delta between the middle and end of the column 206.

The adjustable DAC 404 (digital-to-analog convertor) in the closed-loop thermal control feedback circuit 210 produces offset steps that manipulate the amplifier output voltage associated with a thermal sensor 212 at the end of a nozzle column 206 (e.g., thermal sensor 212B at the end of left nozzle column 206A). Manipulating the amplifier output voltage during calibration of the feedback circuit 210 is useful for eliminating system offsets and device mismatches between the thermal sensors 212, the amplifiers 400, and devices in the differential input pair within the comparator 402. The feedback circuit 210 for each thermal control zone is calibrated during wafer level testing by monitoring the comparator 402 output to determine the offset voltage in the system. The calibration method involves determining the appropriate output of the adjustable DAC 404 such that the comparator 402 output turns on only when the temperature at the end of the nozzle column 206 is less than the temperature at the middle of the nozzle column 206. The appropriate DAC setting is chosen to eliminate the system offset voltage.

As noted above, each closed-loop thermal control feedback circuit 210 is associated with a thermal control zone and includes a pair of thermal sensors 212, one located at the middle of a nozzle column 206 and one located at an end of the nozzle column 206 (e.g., thermal sensors 212A and 212B). However, the thermal sensor at the middle of the nozzle column 206 is shared between two feedback circuits 210 and two thermal control zones. For example, referring to FIG. 2, thermal sensor 212A located at the middle of the left nozzle column 206A is paired with sensor 2128 as part of feedback circuit 210A associated with thermal control zone 1. At the same time, thermal sensor 212A is paired with thermal sensor 212C as part of feedback circuit 210B associated with thermal control zone 2. Thus, thermal sensor 212A at the middle of the left nozzle column 206A is shared between feedback circuit 210A in zone 1 and 210B in zone 2. Likewise, thermal sensor 212D located at the middle of the right nozzle column 206B is paired with sensor 212E as part of feedback circuit 210C associated with thermal control zone 3, while at the same time being paired with thermal sensor 212F as part of feedback circuit 210D associated with thermal control zone 4. Therefore, thermal sensor 212D is shared between feedback circuit 210C in zone 3 and feedback circuit 210D in zone 4. Accordingly, in one embodiment such as shown in FIG. 2, there are four thermal control zones per fluid slot 200 (two zones on each side of the slot 200), and each zone has an associated feedback circuit 210 with a pair of thermal sensors 212 made up of a sensor at the end of a nozzle column 206 and a shared sensor at the middle of the nozzle column.

Figure 5:
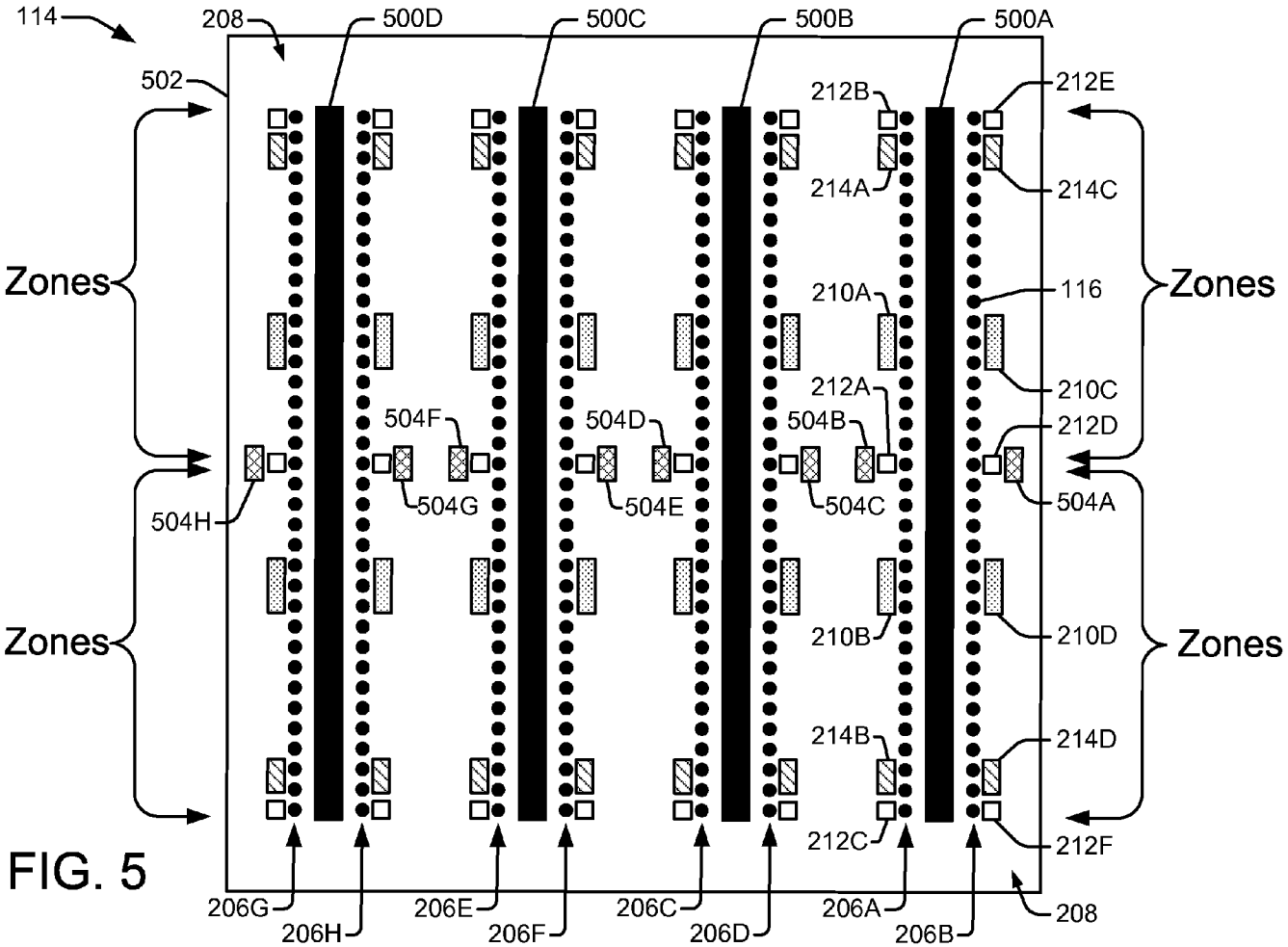
FIG. 5 shows a bottom view of a TIJ printhead as a fluid ejection assembly having multiple fluid slots formed in a silicon die substrate, according to an embodiment.

FIG. 5 shows a bottom view of a TIJ printhead as a fluid ejection assembly 114 having multiple fluid slots 500 formed in a silicon die substrate 502, according to an embodiment of the disclosure. The multi-slot die 502 embodiment generally includes a number of single-slot embodiments (e.g., the single-slot embodiment of FIG. 2), duplicated next to one another across a monolithic silicon die substrate 502. For example, the multi-slot embodiment shown in FIG. 5 has four fluid slots 500 (i.e., slots 500A, 500B, 500C, 500D) formed parallel to one another in the die substrate 502. Such multi-slot assemblies 114 are useful, for example, in color printing systems implementing multiple colors such as a CMYK (Cyan, Magenta, Yellow, and Black) color system where each slot 500 conducts a single color. Although the multi-slot embodiment shown in FIG. 5 shows four fluid slots 500, other multi-slot embodiments may have a fewer or greater number of slots, such as three slots or six slots, for example.

Each of the fluid slots 500A, 500B, 500C and 500D, in the multi-slot die 502 of FIG. 5 has the same general configuration as the single-slot embodiment described above with respect to FIG. 2. Therefore, each slot 500 has four thermal control zones per fluid slot 500 (two zones on each side of the slot 500, not individually referenced in FIG. 5 illustration), and each zone has an associated closed-loop thermal control feedback circuit 210 with a pair of thermal sensors 212 made up of a sensor at the end of a nozzle column 206 and a shared sensor at the middle of the nozzle column. Consequently, feedback circuits 210 on the multi-slot die 502 monitor and control each thermal control zone across the multi-slot die 502 in the same manner as feedback circuits 210 on the single-slot die 202 shown in FIG. 2. That is, each feedback circuit 210 around a fluid slot 500 continuously senses and compares the temperature at the middle of a nozzle column 206 to the temperature at the end of the nozzle column 206. This comparison enables a comparator to turn a heater circuit on and off as needed at the end of the nozzle column 206 when the ends of the die 502 are too cool. The heating circuit is turned on and off with a duty cycle that is proportional to the heating power needed to adjust the temperature at the end of the nozzle column 206 to within an acceptable delta from the temperature at the middle of the nozzle column 206. As heat from the heating circuit transfers through the die 502, a feedback loop is completed back to a thermal sensor. The temperature delta between the middle and end of a column 206 can be maintained such that various temperature profiles are possible across a thermal control zone.

In the multi-slot die 502 configuration of FIG. 5 it is possible that temperature differences develop not only between the middles and ends of nozzle columns 206, but also between the middles of different nozzle columns across the die. For example, in the case where a particular color in a multi-color print system is being printed more than the other colors, such as when a lot of text is being printed with black ink, the thermal control zones around the fluid slot 500 carrying the black ink will heat up more than the thermal control zones around fluid slots carrying other colors. More specifically, assuming slot 500A carries black ink, and that mostly black text is being printed, the die 502 at the middles of nozzle columns 206A and 206B (FIG. 5) will begin to heat. Consequently, the feedback circuits 210A-D will activate heating circuits 214A-D at the ends of columns 206A and 206B, and the die ends at the ends of columns 206A and 206B will be heated appropriately. Thus, an appropriate temperature profile across the thermal control zones around slot 500A can be maintained. However, in this scenario it is apparent that temperature differences may develop between the thermal control zones associated with slot 500A and the thermal control zones associated with the other fluid slots 500B, 500C and 500D, whose nozzle columns are not being exercised.

Accordingly, in some multi-slot die 502 embodiments such as in FIG. 5, additional heating circuits 504 are disposed at the middles of nozzle columns 206 to compensate for temperature differences sensed between the middles of different nozzle columns across the die. For example, near the middles of each of the nozzle columns 206A-H in the multi-slot die 502 in FIG. 5, there are the additional corresponding heating circuits 504A-H. Although the additional heating circuits 504 are illustrated and described in FIG. 5 as being in particular locations, their precise locations near the middles of the nozzle columns, and with respect to other circuitry on the die 502, are somewhat flexible. In multi-slot die 502 embodiments, these middle-column heating circuits 504 (504A-H) help maintain temperature profiles across the entire die 502 and not just between the middles and ends of individual nozzle columns 206. The temperatures of the various nozzle columns 206 are effectively controlled to match the hottest nozzle column, or to have a temperature profile based on the hottest nozzle column.

In embodiments where additional middle-column heating circuits 504 are present, each feedback circuit 210 associated with a fluid slot 500 continuously senses and compares die temperatures between the middles and ends of nozzle columns 206 as well as between the middles of different nozzle columns 206. These comparisons enable a comparator to turn heater circuits (214, 504) on and off as needed at the ends and middles of nozzle columns 206 in order to adjust the temperatures at the ends and middles of the nozzle columns 206 to within an acceptable delta across the entire die 502. The temperature delta can be maintained such that various temperature profiles are possible across both individual thermal control zones and across the entire die 502.

Figure 6:
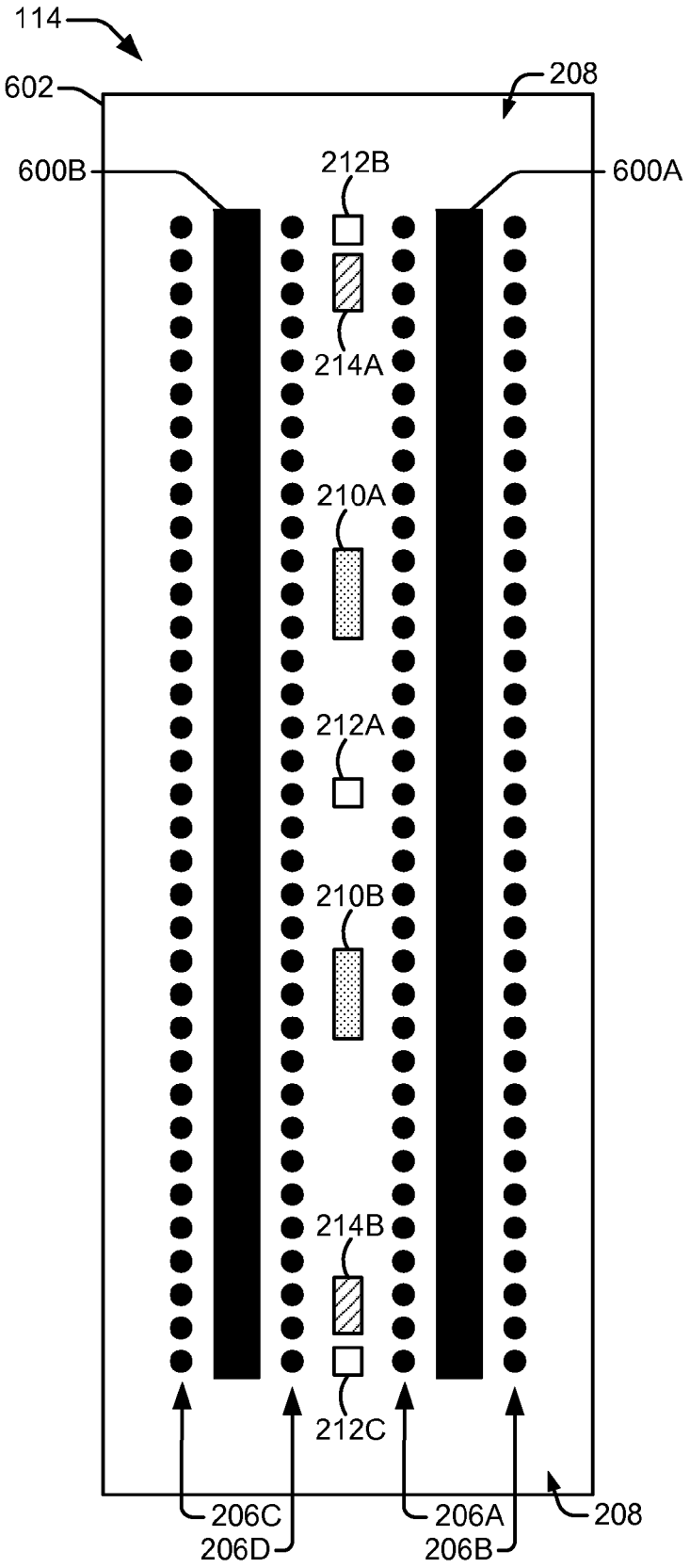
FIG. 6 shows a bottom view of a TIJ printhead as a fluid ejection assembly having multiple fluid slots formed in a silicon die substrate, according to an embodiment.

FIG. 6 shows a bottom view of a TIJ printhead as a fluid ejection assembly 114 having multiple fluid slots 600 formed in a silicon die substrate 602, according to an embodiment of the disclosure. As noted above regarding the multi-slot embodiment of FIG. 5, other embodiments can have fewer or greater numbers of slots. Accordingly, the multi-slot embodiment of FIG. 6 has two fluid slots 600A and 600B that are each configured in a manner similar to the single-slot embodiment of FIG. 2, and that are duplicated next to one another across a monolithic silicon die substrate 602. In the FIG. 6 embodiment, rather than each slot 600 having four thermal control zones per fluid slot (i.e., two zones on each side of the slot) with each zone having an associated closed-loop thermal control feedback circuit 210 with a pair of thermal sensors 212, thermal control zones are shared between fluid slots in the rib space between slots 600 (ribs are regions of the silicon die between a pair of slots). Thus, a thermal sensor 212A is located at the center of the rib of die 602 near the middle of both nozzle columns 206A and 206D, and a sensor 212B is located at the top of the rib near the end of die 602, in between both nozzle columns 206A and 206B. Likewise, instead of having heating circuits located near the ends of each nozzle column, heating circuits 214A and 214B are located at each end of the rib in between both nozzle columns 206A and 206D. By way of comparison to the multi-slot embodiment of FIG. 5, the configuration of FIG. 6 reduces the circuitry between slots and occupies less die area. In addition, because the heat transfer distance across a rib is short in comparison to the heat transfer distance along the length of a rib, this configuration provides a significant advantage in temperature profile control while using less die space.

Figure 7:
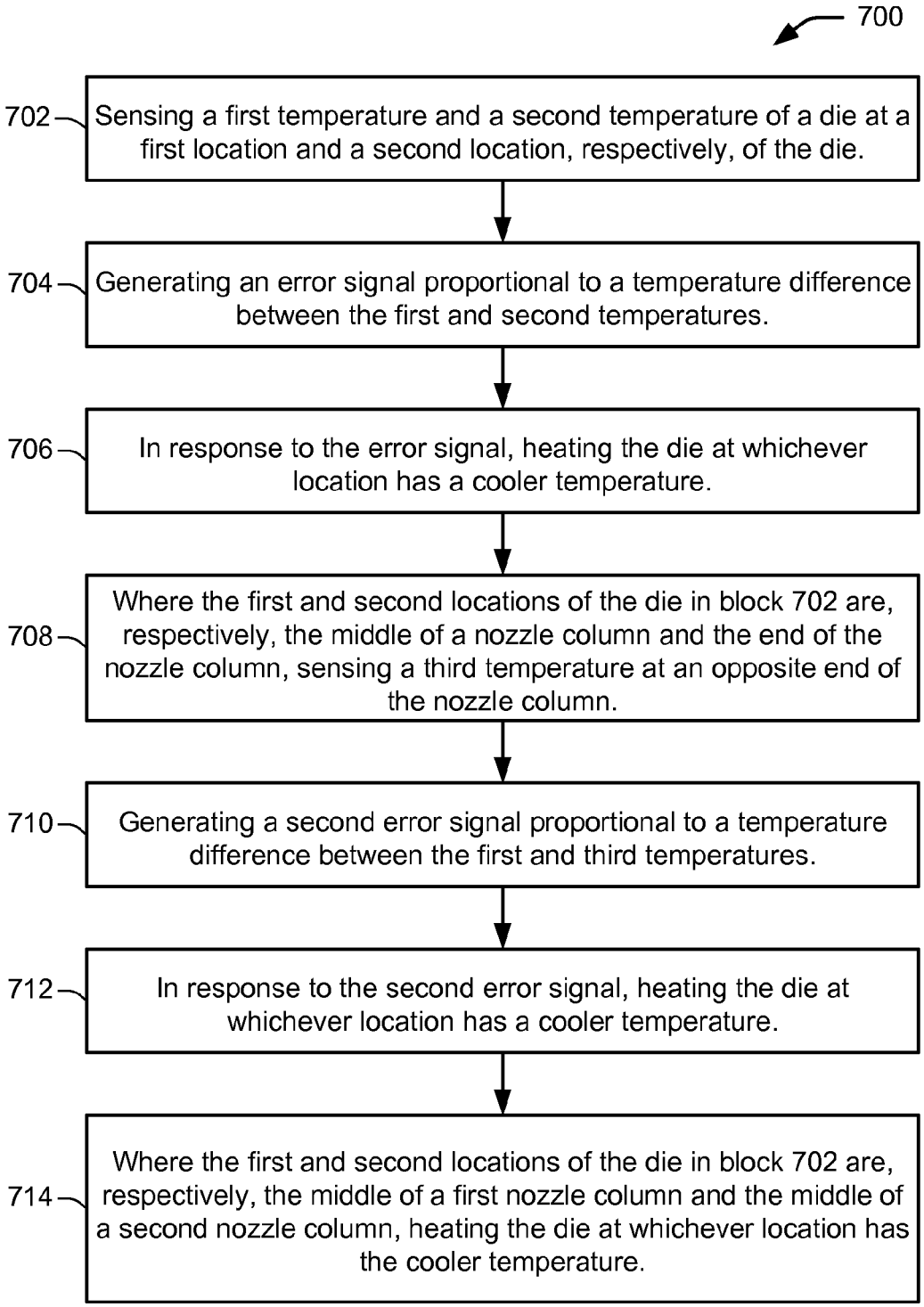
FIG. 7 shows a flowchart of an example method of creating a thermal profile across a fluid ejection die assembly, according to an embodiment.

FIG. 7 shows a flowchart of an example method 700 of creating a thermal profile across a fluid ejection die assembly, according to an embodiment of the disclosure. Method 700 is associated with the embodiments of a fluid ejection assembly 114 discussed above with respect to illustrations in FIGS. 1-6.

Method 700 begins at block 702 with sensing a first temperature and a second temperature of a die at a first location and a second location, respectively, of the die. Thermal sensors formed on the die in different spatial locations, such as near the middle of a nozzle column and near the end of the nozzle column, continually sense the die temperature at their respective locations. At block 704 of method 700, an error signal is generated based on differences between the first and second temperatures. The error signal is proportional to the magnitude of difference between the first and second temperatures. At block 706 of method 700, in response to the error signal, the die is heated at whichever die location has a cooler temperature. For example, the second temperature measured at the die location near the end of the nozzle column is generally cooler than the first temperature measured at the middle of the nozzle column. Therefore, a heater near the end of the nozzle column is turned on and off by the error signal with a duty cycle in proportion to the magnitude of temperature difference between the first and second temperatures, resulting in heating of the die end near the end of the nozzle column.

The method 700 continues at block 708, where the first and second locations of the die in block 702 are, respectively, the middle of a nozzle column and the end of the nozzle column, with sensing a third temperature at an opposite end of the nozzle column. At block 710 a second error signal is generated that is proportional to a temperature difference between the first and third temperatures. At block 712, in response to the second error signal, the die is heated at whichever location has the cooler temperature. This is typically the opposite end of the nozzle column. A heater near the opposite end of the nozzle column, for example, is turned on and off by the second error signal in proportion to the magnitude of temperature difference between the first and third temperatures, resulting in heating of the die end near the opposite end of the nozzle column. The result of method steps 702-712 is that the temperature of the die along which the nozzle column is located is controlled to match a particular temperature profile.

The method 700 continues at block 714, wherein the first and second locations of the die in block 702 are, respectively, the middle of a first nozzle column and the middle of a second nozzle column. At block 714, the die is heated at whichever location has the cooler temperature. The location that is cooler is typically whichever nozzle column is printing the least prior to the time the temperatures are measured. Step 714 generally enables controlling temperature across the die surface in embodiments where there are multiple fluid slots and multiple nozzle columns. In such embodiments, it is beneficial to not only control temperature profiles between the middle and ends of particular nozzle columns, but also to control temperature profiles between multiple nozzle columns associated with multiple fluid slots across the surface of the die.

What is claimed is:

1. A fluid ejection assembly comprising:

a pair of fluid slots formed in a die, the pair of slots forming a rib with a first end, a second end, and a center between the first and second ends;

a first column of nozzles disposed on and along a side of the rib;

a pair of thermal sensors located on the rib, the pair of thermal sensors comprising a first thermal sensor located on the center of the rib; and a heater located on the rib, wherein the heater is in addition to any firing resistors.

2. The fluid ejection assembly of claim 1, wherein the heater is located at the first end of the rib.

3. The fluid ejection assembly of claim 1, wherein the heater is located at the center of the rib.

4. The fluid ejection assembly of claim 1, further comprising a third thermal sensor located at the second end of the rib.

5. The fluid ejection assembly of claim 4, further comprising a heater located on the rib, wherein the heater is in addition to any firing resistors.

6. The fluid ejection assembly of claim 5, wherein the heater is located on the center of the rib.

7. The fluid ejection assembly of claim 5, wherein the heater comprises a plurality of heaters.

8. The fluid ejection assembly of claim 7, wherein one of said plurality of heaters is located at the first end of the rib and a second of the plurality of heaters is located at the second end of the rib.

9. The fluid ejection assembly of claim 8, wherein one of the plurality of heaters is located on the center of the rib.

10. The fluid ejection assembly of claim 1, wherein a thermal control circuit is located on the rib.

11. The fluid ejection assembly of claim 1, wherein the pair of thermal sensors are configured to generate a control signal for the heater.

12. The fluid ejection assembly of claim 11, wherein logic to generate the control signal for heater is located on the rib.

13. The fluid ejection assembly of claim 1, further comprising a second rib with a second column of nozzles and a fourth thermal sensor, wherein output of a thermal sensor on the first rib and output of the fourth thermal sensor on the second rib are used to generate a control signal for the heater on the first rib.

14. A thermal inkjet printing device comprising:

a fluid ejection die having a fluid supply slot and first and second columns of nozzles to eject fluid drops; and a heating system disposed on the die to maintain a temperature profile across a surface of the die through selective application of heat to different areas of the die in response to temperature data sensed at different areas of the die, the heating system comprising a plurality of sensors and a plurality of heaters, wherein the heating system compensates for thermal gradients both parallel to and not parallel to the nozzle columns.

15. A thermal inkjet printing device as in claim 14, wherein the heating system further comprises a heater located at the center of the die, wherein the heater is in addition to any firing resistors.

16. A thermal inkjet printing device as in claim 14, wherein heat applied in an area of the die is applied by turning a heater on and off with a duty cycle proportional to a temperature difference between two thermal sensors on the die.

17. A thermal inkjet printing device as in claim 14, further comprising a second column of nozzles parallel to the first column of nozzles, wherein the heating system reduces variation in temperature between the first and second columns of nozzles.

18. A thermal inkjet printing device comprising:

a die with a first rib and a second rib, each rib being defined by a pair of slots;

a first thermal sensor located on the first rib;

a second thermal sensor located on the second rib;

a heater located on the first rib;

a control signal to drive the heater based on a difference in temperature between the first and second thermal sensors.

19. A thermal inkjet printing device as in claim 18, wherein the heater is in addition to any firing resistors.

* * * * *